US005205492A

United States Patent [19]

Khinchuk

[11] Patent Number: 5,205,492

[45] Date of Patent: Apr. 27, 1993

[54] FUEL INJECTION VALVE

[76] Inventor: Gregory Khinchuk, 15 Westbourne Ter., Apt. #3, Brookline, Mass. 02146

[21] Appl. No.: 807,179

[22] Filed: Dec. 16, 1991

[51] Int. Cl.[5] ..... F02M 61/10

[52] U.S. Cl. ..... 239/533.4; 239/533.9

[58] Field of Search ..... 239/533.2-533.12

[56] References Cited

U.S. PATENT DOCUMENTS

| | | | |
|---|---|---|---|
| 1,973,666 | 9/1934 | Sidney | 239/533.8 |
| 2,391,808 | 12/1945 | Vincent | 239/533.8 |
| 2,613,998 | 10/1952 | Noon et al. | 239/533.2 |
| 2,626,186 | 1/1953 | Nakken | 239/533.11 X |
| 3,282,512 | 11/1966 | Bluhm et al. | 239/533.8 |
| 4,546,924 | 10/1985 | Winquist | 239/533.4 |
| 4,646,975 | 3/1987 | Horn | 239/533.9 |
| 4,768,719 | 9/1988 | Straubel et al. | 239/533.4 |
| 4,976,518 | 10/1988 | Yamamoto | 239/533.4 |

FOREIGN PATENT DOCUMENTS

| | | | |
|---|---|---|---|
| 670773 | 4/1952 | United Kingdom | 239/533.2 |

*Primary Examiner*—Andres Kashnikow
*Assistant Examiner*—Kevin P. Weldon

[57] ABSTRACT

The fuel injection valve for injecting fuel into a combustion chamber of an internal combustion engine comprises a valve housing and nozzle, having a nozzle body 1 with an axial bore 13 which has a slidable but not liquid-tight fitted nozzle needle 3 for reciprocating movement between opened and closed positions. In the upper portion of the axial bore 13 the sealing bellows 5 is fitted. The bottom of the bellows 5 is permanently kept in contact with upper end face of the nozzle needle 3. The bellow's flange is held in liquid-tight fashion between space 8 and top end face of the nozzle body for sealing the clearance between nozzle needle and body. A push rod 6 is the bellows 5 to impart an urging spring force to the nozzle needle 3. During the operation the nozzle needle 3 is lifted in unison with the bellows 5 against increased fuel pressure within the axial bore 13 in addition to the urging force of the nozzle spring 18. Thus a gradual lifting motion of the nozzle needle 3 is achieved and accordingly the fuel injection quantity is gradually increased at the start of the injection.

3 Claims, 2 Drawing Sheets

FUEL INJECTION VALVE

BACKGROUND OF THE INVENTION

This invention relates to a fuel injection valve for internal combustion engines, particularly for diesel engines.

The main function of the fuel injection valve is to atomize a metered amount of fuel and supply it to the correct region in the combustion chamber. The atomization process depends greatly on the injection pressure that is affected significantly by the very small clearance between the nozzle needle valves and its barrel.

Significant leakage through the small clearance between valve and barrel of the nozzle is prevented solely by the excellence of the fit between these parts. Manufactured from alloy steels and lapped together as a mated assembly they are not individually interchangeable. Meeting the tolerances requires a specialized lapping tool and the resulting parts are custom rather than randomly mated. Conventional nozzles are fast wearing owing to the conditions of operation by which the contacting surfaces of the nozzle needle and bushing are compelled to work at high linear speed and at a very high friction. In cases where the engine is running on lighter fuels such as No. 1 diesel, jet fuels or methanol, the low level lubricity of these fuels is conducive to even greater wear, scoring and abrasion between the co-acting needle and barrel surfaces. In its turn this clearance deterioration causes a low injection pressure which leads to a malfunction of the engine.

Several attempts to develop a fuel injection valve with large clearance between the nozzle needle and its barrel are known. These valves have a housing with the nozzle chamber and spring chamber sealed off from one another. The sealing off is effected in these known valves by a disk shaped rubber diaphragms generally secured in the desired position by vulcanization techniques. These valves were disclosed in U.S. Pat. Nos. 1,814,443 (1931) to Morris J. Goldberg, 2,470,717 (1949) to Vincent Palumbo, 2,750,957 (1956) to Bruno Tavola and German Patent 3614564 (1986) to Hafner Gunter. An East German Patent 264055 (1989) to Winkler Bernd and Polster Christfried shows a nozzle where the nozzle needle has a rubber or plastic elastic sleeve and this needle is vulcanized in the needle barrel. The elastic sleeve provides the lift of the needle and completely prevents the fuel leakage along the needle valve. However, those type of fuel valves are not reliable and are expensive to manufacture.

Another problem with the current valves is associated with the fuel injection rate at the early stage of the injection. To satisfy the recent requirements for the cleaning of the exhaust air and the saving of the fuel consumption, it has been found that it is desirable that a rate of injection slowly increases at an early period of the fuel injection process and rapidly decreases at the end.

To meet this requirement several types of the two-stage injectors with reduced fuel injection rate throughout the initial injection stroke have been proposed. For example, in U.S. Pat. Nos. 4,852,808 (1987) to Joshihisa, and 4,913,113 to Georges (1989), in Great Britain Patent 2223798 (1988) to Nicol Stuart William and 2215395 (1988) to Lintoff Edward Robert, in German Patents 3820509 (1988) to Komaroff Iwan et al and 3819814 (1988) to Robert Bosch. However, in these fuel injectors, in contrast to a conventional one, numerous component parts are required and this substantially increases their dimensions, weight and cost. Many of these two-stage injectors have been limited to use only in larger displacement engines.

SUMMARY OF THE INVENTION

It is the objective of this invention to provide a simple and practical means, readily adaptable to conventional fuel injection valves, which will substantially relax the close tolerances and reduce the cost of the valve by avoiding the lapping and custom hand making.

Further special objectives of the invention is to provide a fuel injection valve for an internal combustion engine of a simple construction which is capable of maintaining a slow fuel injection rate at the early stage of the injection, thereby contributing to improving engine noise and emission characteristics.

To achieve these goals according to the invention, the conventional fuel injection nozzle generally comprising a nozzle body, a spray tip with the discharge orifices and an axially movable fuel control valve within the nozzle body is provided with a sealing bellows. This bellows secures the axial movement of the valve and completely prevents the fuel leakage along the valve. Besides, this bellows can act as a spring at the initial stage of injection.

This novel valve is capable of improving several aspects of diesel engine performance while simultaneously enabling to achieve a reduction in the fuel injection valve cost.

These and other objects and advantages of the present invention will become more apparent from the following description with the accompanying drawings.

DETAILED DESCRIPTION

Figure 1:
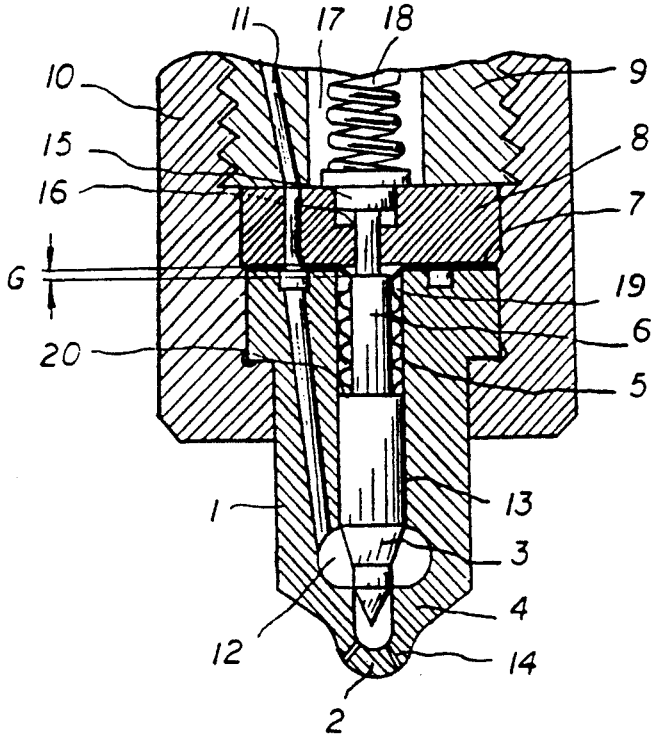
FIG. 1 shows a vertical sectional view of a valve according to the first embodiment.

FIG. 1 shows a first example of the fuel injection valve according to the present invention. The fuel injection valve consists of a nozzle body 1 with a spray tip 2 and an axial bore 13 formed therein along its axis in which a nozzle needle valve 3 is fitted with a large clearance and consequently not liquid-tight for movement through a predetermined stroke G. The needle is engaged with the valve seat to control fuel flow into combustion chamber from the fuel source (not shown). The tip 2 is provided with at least one discharge orifice 14. The nozzle needle 3 is lifted in response to the pressure of fuel supplied into the pressure chamber 12. The main novelty of the present invention is a sealing bellows 5. This bellows 5 is fitted in the upper portion of the axial bore 13 and is displaceable in unison with the nozzle needle 3. The bottom contact surface of the bellows 5 is less than cross-sectional area of the upper end face of the nozzle needle 3, therefore there is an annular area 20 on the upper face of the needle 3. A back pressure chamber 19 is formed around the bellows 5 above the nozzle needle 3 and communicated with pressure chamber 12 through the needle clearance. The bellow's flange 7 is interposed between the lower surface of the needle stop spacer 8 and the top end face of the nozzle body 1.

The whole assembly is held together and secured to the nozzle holder 9 by means of a retaining nut 10. Tightening retaining nut 10 assures a leak proof connection between the nozzle body 1, bellows 5, spacer 8, and holder body 9. A movable spring seat 15 is located in an axial through bore 16 formed in the spacer 8 along its axis. The nozzle holder 9 has a spring chamber 17 in which is a nozzle spring 18. The pressure spring 18 is arranged between the movable spring seat 15 and its upper stationary seat (not shown). A stepped push rod 6 is interposed between movable spring seat 15 and the bottom. The larger diameter of the push rod 6 is equal to the internal diameter of the bellows 5 in order to reinforce and protect it from being collapsed by the high pressure fuel in the chamber 19. A whole lifting gap G, through which the nozzle needle 3 lifts for fuel injection, is provided between stepped shoulder of the push rod 6 and an opposed end face of the spacer 8.

During the operation, fuel under high pressure generated by a fuel source flows through the fuel duct 11 in the nozzle holder body 9 entering into the pressure chamber 12 and through the needle clearance into back pressure chamber 19. When the pressure within the pressure chamber 12 reaches a valve opening pressure, which is determined by the load of the spring 18 and the combined pressures of the bellows 5 and the fuel pressure within back pressure chamber 19 applied to the exposed annular area 20 of the needle valve 3 and pressure-receiving surface of the bellows 5, the needle valve 3 starts to lift for injection of fuel through the discharge orifice 14. As the nozzle needle 3 lifts, the increasing pressure within back pressure chamber 19 will slow down motion of the nozzle needle 3 and also the fuel injection rate. Subsequently, the fuel supplied to the engine during the period between the start of the injection and firing within the engine cylinder is reduced thereby reducing engine noise and restraining NOx from being generated. The fuel injection terminates when the nozzle needle 3 returns to its initial seated position after completing the lifting stroke G.

Figure 2:
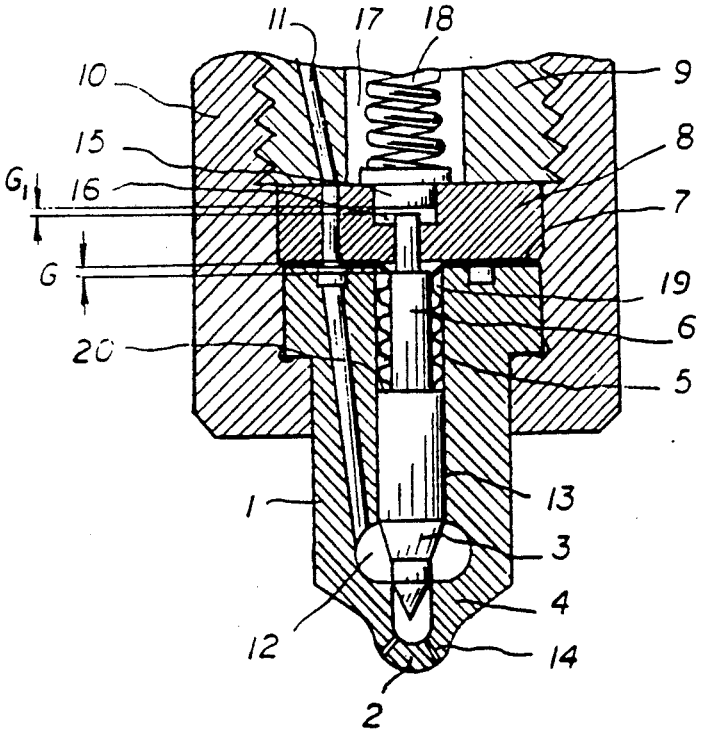
FIG. 2 shows a vertical sectional view of a valve according to the second embodiment.
Figure 3:
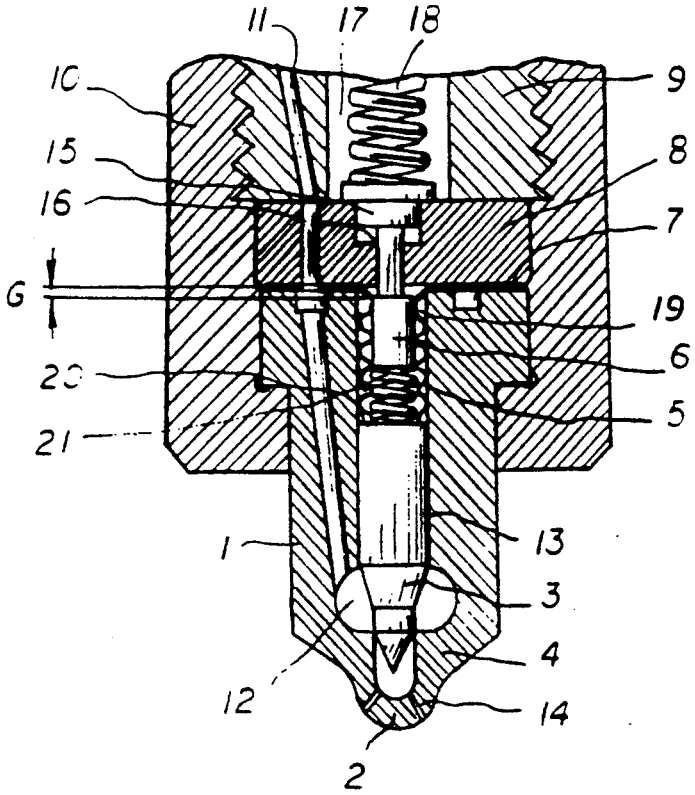
FIG. 3 shows a vertical sectional view of a valve according to the third embodiment.

In the embodiments of FIG. 2 and FIG. 3 the same parts having the same functions as those shown in the foregoing first embodiment are designated by the same reference numerals.

The second embodiment shown in FIG. 2 differs from the first embodiment by the fact that when the nozzle needle 3 assumes its seated position there is an initial lifting gap G1 provided between an end face of the push pin 6 and a lower end face of the movable spring seat 15. In this case, when the pressure in the pressure chamber 12 reaches a first valve opening pressure which is determined by the load of only the bellows 5 and the fuel pressure in the back pressure chamber 19 which is applied to the exposed annular area 20 of the needle valve 3 and the bellows 5, the needle valve 3 has moved away from the seat 4 thereby opening the discharge orifice 14. When the needle valve 3 is moved away from the seat 4 by a distance of the preset gap G1, the push pin 6 comes into contact with the spring seat 15 and stops. At this time the opening degree of the fuel passage is small and the fuel injection rate through the discharge orifices 14 is also small. As the fuel pressure is further increased to exceed the sum of the urging forces of the bellows 5 and the spring 18, the nozzle needle 3 further lifts to complete the whole injection corresponding to the whole lifting gap G.

When the fuel pressure from the injection pump decreases, the nozzle needle 3 is returned rapidly to its seat by the action of the spring 18 and bellows 5, but when the spring seat 15 reaches the upper surface of the spacer 8, the push pin 6 and spring seat 15 then lose contact with each other. After that the nozzle needle 3 will move in the closing direction only by the action of a smaller force. As a consequence, the nozzle needle 3 is struck against its seat by a weak force and breakage of the tip portion of the nozzle body is avoided.

FIG. 3 shows the third embodiment that is different from the first one shown in FIG. 1 in that a pressure spring 21 for the nozzle needle 3 is arranged inside the bellows 5 between the push rod 6 and the bottom and the outside diameter of the spring 21 is equal to the internal diameter of the bellows 5. This additional spring 21 allows increases the first valve opening pressure when the spring rate of the bellows 5 is small. In such a case, the initial lifting gap is provided by the clearance between the coils of the spring 21.

In summary, it will be seen that use of the proposed fuel injection valve allows:

- Increase life time and reduces the cost of the nozzle by operating it at large needle clearances.
- Reduce the number of rejected nozzles during the manufacturing process as a result of the flexibility to use nozzle with large needle clearances.
- Efficient operation of the diesel engine with light liquid fuel like jet fuel or methanol that have poor or no lubricating properties.
- Eliminate sensitivity of the engine performance to the deviation of the needle clearance.
- Optimizes fuel injection quantity supplied to the engine during the period between the start of the injection and firing within the cylinder and accordingly reduces engine noise and restrain NOx from being generated.

This invention could lead to the development of an entirely new type of fuel injection valve designed to simplify, cheapen and facilitate production and assembly of it's parts and to increase the efficiency, durability and reliability of the device.

Modifications within the scope of the invention will be possible for those skilled in the art after reviewing the present disclosure.

I claim:

1. A fuel injection valve for an internal combustion engine, comprising:

- a nozzle holder having a fuel inlet port connected to a fuel injection pump;
- a nozzle body attached to said nozzle holder and having an axial bore, a spray tip with at least one discharge orifice, a pressure chamber and fuel passage provided for communication of said pressure chamber with said fuel inlet port;
- a nozzle need being slideable fitted into the said axial bore of said nozzle body in a not liquid-tight manner to open and close said discharge orifice in response to the pressure change of fuel supplied into said pressure chamber;
- a spacer interposed between said nozzle body and said nozzle holder;
- a movable spring seat located in an axial through hole formed in said spacer along its axis;
- a valve spring interposed between said movable spring seat and stationary spring seat for urging said nozzle needle in the direction of closing said discharge orifice;

a bellows arranged within said axial bore of said nozzle body coaxially with said nozzle needle and the bottom of said bellows permanently kept in contact with an upper end face of said nozzle needle and the flange of said bellows held in a liquid-tight manner between a lower surface of said spacer and top end face of said nozzle body for sealing the clearance between said nozzle needle and said nozzle body, wherein the bottom contact surface of said bellows is smaller than the cross-sectional area on the upper end face of said nozzle needle;

a stepped push rod, having the larger outside diameter equal to the internal diameter of said bellows is interposed between said movable spring seat and the bottom of said bellows to impart an urging spring force to said nozzle needle and for providing a lifting gap between the stepped portion of said push rod and the lower surface of said spacer.

2. A fuel injection valve as claimed in claim 1 wherein a pressure spring is arranged inside said bellows between said bottom of the bellows and said push rod and outside diameter of said spring is equal to the internal diameter of said bellows.

3. A fuel injection valve as claimed in claim 1 wherein between said movable spring seat and said push rod there is an axial gap during initial lifting of said nozzle needle.

* * * * *